United States Patent [19]

Tamura et al.

[11] Patent Number: 4,586,969

[45] Date of Patent: May 6, 1986

[54] FE-NI-TI-CO ALLOY WITH SHAPE MEMORY EFFECT AND PSEUDO-ELASTICITY AND METHOD OF PRODUCING THE SAME

[75] Inventors: Imao Tamura, Kyoto; Tadashi Maki, Settsu, both of Japan

[73] Assignee: Kyoto University, Kyoto, Japan

[21] Appl. No.: 711,810

[22] Filed: Mar. 14, 1985

[30] Foreign Application Priority Data

May 9, 1984 [JP] Japan ..... 59-90874

[51] Int. Cl.[4] ..... C22C 38/08; C22C 30/00

[52] U.S. Cl. ..... 148/402; 148/142; 75/123 K; 75/123 M

[58] Field of Search ..... 75/123 K, 123 M; 148/402, 442, 37, 142

[56] References Cited

U.S. PATENT DOCUMENTS 4,204,887 5/1980 Masumoto et al. ..... 75/123 K

FOREIGN PATENT DOCUMENTS 57-63655 4/1982 Japan ..... 148/402

58-157935 9/1983 Japan ..... 148/402

*Primary Examiner*—L. Dewayne Rutledge

*Assistant Examiner*—Deborah Yee

*Attorney, Agent, or Firm*—Fleit, Jacobson, Cohn & Price

[57] ABSTRACT

The disclosed alloy with a shape memory effect and a pseudo-elasticity exhibits a thin-plate martensitic structure, which alloy is made by heating an alloy consisting of 32–34 wt. % of nickel, 3–6 wt. % of titanium, 10–15 wt. % of cobalt and the remainder of Fe to a temperature between 900° C. to 1,200° C. and effecting an aging treatment at a temperature between 500° C. and 800° C. so as to generate a thin-plate martensite.

2 Claims, 20 Drawing Figures

Solution Treated Only
Befor Deformation at -196 °C

After Deformation at -196 °C

After Heating to Room Temperature
Nothing

Aged for 1 Hour at 700 °C

Pseudo-Elastic Phenomenon

Aged for 5 Hours at 700 °C

Shape Memory Phenomenon

-100°C 50μm

-150°C

-140°C

-160°C

FE-NI-TI-CO ALLOY WITH SHAPE MEMORY EFFECT AND PSEUDO-ELASTICITY AND METHOD OF PRODUCING THE SAME

BACKGROUND OF THE INVENTION

1. Field of the Invention

The present invention relates to a functional metallic material, especially relates to a metallic material showing a shape memory effect and a pseudo-elasticity.

2. Description of the Prior Art

Shape memory alloys have a possibility for being applied to various fields such as industry, energy, medical science by utilizing its unique facility, and these alloys are utilized in those fields. The shape memory effect and the pseudo-elasticity appear in alloys which cause a thermo-elastic martensitic transformation. As for metallic materials showing such phenomena, there has been found mainly in a non-ferrous alloy such as Ti-49~51 at. % Ni, Ni-36~38 at. % Al, Cu-38~42 wt. % Zn, Cu-14 at. % Al-3~4.5 at. % Ni, Cu-15 at. % Sn, Au-46~50 at. % Cd and In-18~23 at. % Tl.

Contrary to this, it is found in a ferrous alloy that Fe-25 at. % Pt and Fe-30 at. % Pd become the thermoelastic martensite and show the complete shape memory effect. Further, it is briefly reported that Fe-23% Ni-10% Co-10% Ti alloy shows the shape memory effect by an aging treatment for one minute at 700° C., but a relation between the shape memory effect and characteristics of martensite for this alloy is not clear. Moreover, it is further reported that Fe-high Nm alloys and Fe—Cr—Ni stainless steels such as 18-8 stainless steel indicate an incomplete and partial shape memory effect when $\epsilon$-martensite is formed. However, since the shape memory effect in the ferrous alloys due to $\epsilon$-martensite is incomplete, the application thereof is largely limited.

The complete shape memory effect and pseudo-elasticity originating from thermoelastic martensite are peculiar properties which do not appear in usual metallic materials, and thus various studies on this application are now continued. However, in actuality, there are three problems with this metallic material, i.e., a manufacturing problem such as melting, working, heat treatment; a problem of obtaining certain properties such as strength, ductility, toughness, fatigue life; and a problem of price.

Among the shape memory alloys mentioned above, Ti—Ni alloys, Cu—Zn alloys and Cu—Al—Ni alloys actually be used, but these alloys are not perfect and have various disadvantages. That is to say, Ti—Ni alloys have good properties, but they require a special technic during the manufacturing operation especially the melting operation and are very expensive. Contrary to this, Cu based alloys are comparatively inexpensive, but they have a poor workability during the manufacturing operation. In addition, they have a bad ductility and easily incur boundary cracks. These disadvantages of the Cu based alloys are the most fundamental problems that must be solved immediately.

Therefore, if the shape memory alloys having good properties for actual use are developed in the compositions other than those alloys mentioned above, it is possible to use this facility most effectively.

SUMMARY OF THE INVENTION

An object of the present invention is to eliminate the drawbacks mentioned above and to provide a shape memory alloy having good properties, good workability and comparatively inexpensive price on the basis of the newly developed alloy.

According to the invention, an Fe—Ni—Ti—Co alloy with a shape memory effect and a pseudo-elasticity consists of 32-34 wt. % of nickel, 3-6 wt. % of titanium, 10-15 wt. % of cobalt and the remainder of Fe, said alloy exhibiting a thin-plate martensitic structure.

Another object of the invention is to provide a method of producing an Fe—Ni—Ti—Co alloy, comprising steps of:

heating an alloy consisting of 32-34 wt. % of nickel, 3-6 wt. % of titanium, 10-15 wt. % of cobalt and the remainder of Fe to a temperature between 900° C. and 1,200° C. so as to effect a homogeneous solution treatment; and effecting an aging treatment at a temperature between 500° C. and 800° C. for less than 100 hours so as to generate a thin-plate martensite corresponding to a cooling or a stress applying operation.

DESCRIPTION OF THE PREFERRED EMBODIMENTS

Figure 1A:
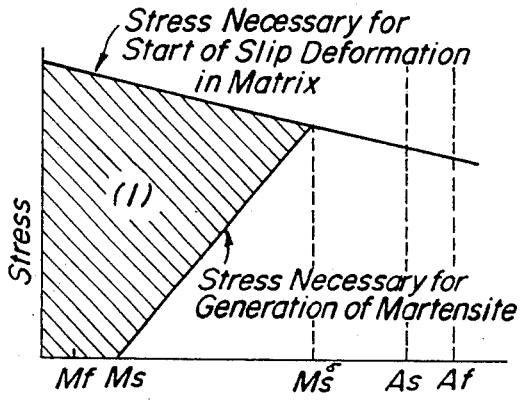
FIGS. 1*a* to 1*f* are schematic views showing appearance conditions of a shape memory effect and a pseudo-elasticity by means of relations between temperature and stress and between temperature and electric resistivity.
Figure 1D:
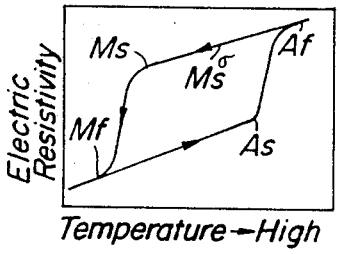
Figure 1B:
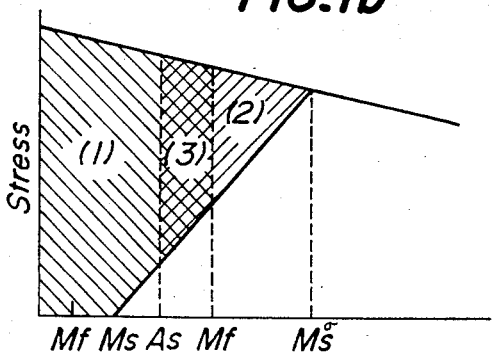
Figure 1E:
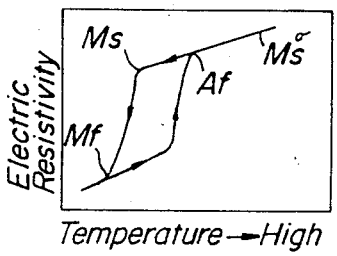

First of all, a thin-plate martensite and its shape memory effect and pseudo-elasticity according to the invention will be explained briefly. The thin-plate martensite has such interesting properties that this martensite is completely twinned and a plastic deformation of austenite matrix does not occur since a stress due to the transformation strain is accommodated by the elastic deformation in a matrix. Preferable factors for the generation of this thin-plate martensite are summarized as follows.

(1) Large strength (yield strength) and small shear modulus of austenite matrix. In both cases, the plastic deformation in the matrix due to the transformation strain becomes hard to occur.

(2) Small volume change at martensite transformation and small amount of transformation shear. In both cases, a strain in the matrix due to the transformation becomes small, and thus the plastic deformation of matrix becomes hard to occur.

(3) Large tetragonality (c/a) of the martensite. Larger the tetragonality c/a becomes, smaller the amount of (112) twinning shear in martensite and the twin boundary energy become. These factors make easy the formation of twins in the martensite and make large the density thereof. Moreover, the amount of transformation shear becomes smaller corresponding to the increase of tetragonality c/a, so that the plastic deformation in the matrix becomes hard to occur.

(4) Low formation temperature of martensite ($M_s$ temperature). The deformation twinning in the martensite becomes easy to occur as compared with the slip deformation, corresponding to the decrease of $M_s$ temperature. Further, the strength of matrix is increased with a decrease in $M_s$ temperature and thus the plastic deformation in the matrix becomes hard to occur.

Then, the shape memory effect and the pseudo-elasticity of the alloy according to the invention which comprises the factors mentioned above will be explained. The alloy according to the invention is deformed at a temperature below a certain temperature. In this case, the deformation method is arbitrarily selected from the usual methods such as bending, tension, compression. Then, the alloy is heated to a temperature above $A_f$ temperature, so that there appears the shape memory effect such that the shape of the alloy is recovered to that before deformation. Further, if applied a certain heat treatment, the alloy according to the invention shows the pseudo-elasticity such that a large elastic deformation appears during the deformation in a certain temperature range. FIGS. 1*a* to 1*f* are schematic views showing appearance conditions of the shape memory effect and the pseudo-elasticity by means of relations between temperature and stress and between temperature and electric resistivity. In FIGS. 1*a* to 1*f*, $M_s$ temperature and $M_f$ temperature indicate respectively a start temperature and a finish temperature of the martensitic transformation on cooling, and $A_s$ temperature and $A_f$ temperature indicate respectively a start temperature and a finish temperature of a reverse transformation such that the martensite is returned to a matrix phase on heating. Moreover, $M_s^{\sigma}$ temperature shows a temperature at which a stress necessary for the generation of a stress-induced martensite is equal to a stress necessary for a slip deformation of the matrix, and in a temperature between $M_s^{\sigma}$ and $M_s$ the martensite forms under the condition that the plastic deformation in the matrix does not occur by the applied stress. Further, FIGS. 1*a*, 1*b* and 1*c* correspond to FIGS. 1*d*, 1and 1*f*, respectively.

In the alloy according to the invention, actual $M_s$, $M_f$, $A_s$ and $A_f$ are varied in a complicated manner corresponding to the alloy composition and the aging condition, but the relative positional relations therebetween become always as shown in FIGS. 1*a* to 1*f*. In case that the martensite generated in the alloy is a thermoelastic (thin-plate) martensite, if the alloy is deformed at a temperature and stress both lying in a region (1) indicated in each figures, the shape memory effect appears by the heating up to a temperature above $A_f$ since the reverse transformation occurs during the heating of the alloy. Moreover, in case tha the deformation is applied to the alloy in a region (2), the complete reverse transformation occurs on unloading at that temperature, and then the pseudo-elasticity appears. Further, in case that the deformation is applied to the alloy in a region (3), the reverse transformation occurs partly on unloading at that temperature which shows a little pseudo-elasticity, and after that the shape memory effect occurs by the heating of the alloy above $A_f$ temperature after the deformation.

Hereinafter, embodiments of the alloys according to the invention which show the thin-plate martensite structure will be explained. At first, Fe, Ni, Ti, Co are vacuum-melted in a high-frequency induction furnace so as to obtain Fe-33.04% Ni-3.94% Ti-10.17% Co alloy (weight %). Then, flat specimens having a thickness of 0.25 mm are manufactured by means of a hot rolling and a cold rolling. After specimens are solution treated at 1,200° C. for one hour, two specimens aged at 700° C. for one hour and five hours and a non-aged specimen for comparison are prepared. These three kinds of specimens are bent by using V-shaped die at a temperature of a liquid nitrogen (−196° C.). After that, these specimens are taken out of the die in the liquid nitrogen and heated to a room temperature. Then, the shape memory effect and the pseudo-elasticity of these specimens are investigated. Further, various observations for these specimens are performed by using an optical microscope with low temperature stage and an X-ray diffraction method so as to examine the behavior of the martensitic transformation.

Figures 2A, 2B, 2C, 2D, 2E, 2F, 2G, 2H, 2I:
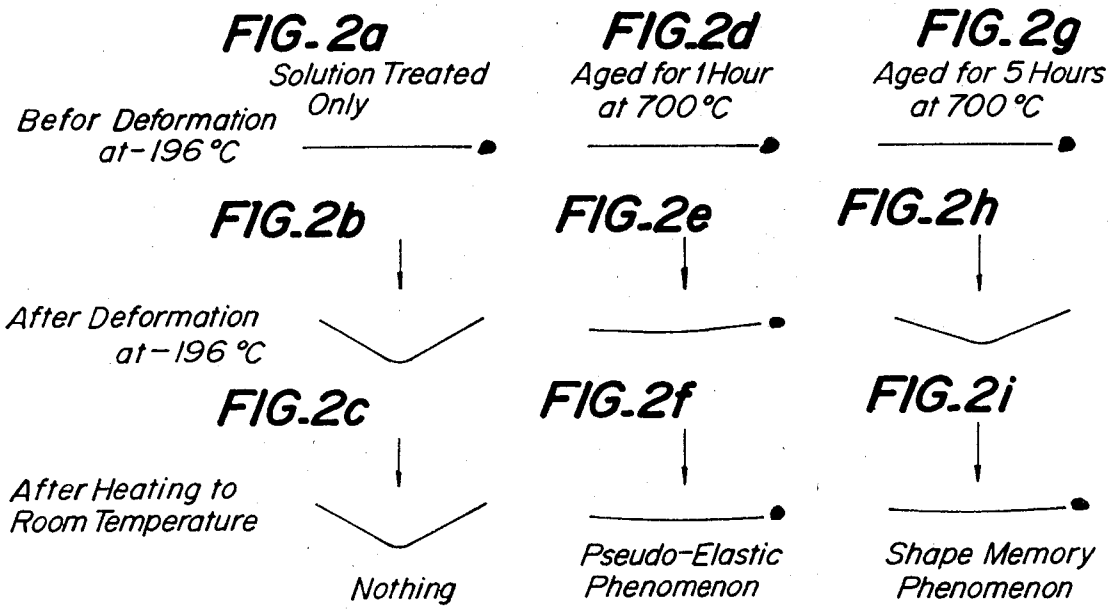
FIGS. 2*a* to 2*i* are examples of investigated results of the shape memory effect and the pseudo-elasticity.
Figure 3A:
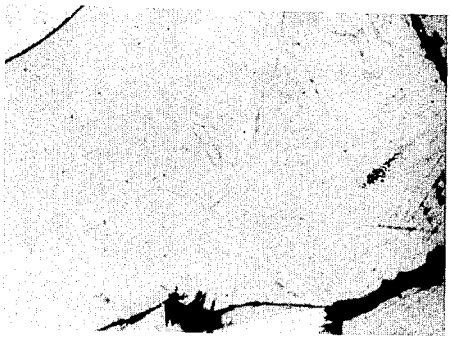
FIGS. 3*a* to 3*e* are optical mcrographs showing a surface relief due to martensitic transformation at various temperatures in the specimen which is aged at 700° C. for five hours.
Figure 3D:
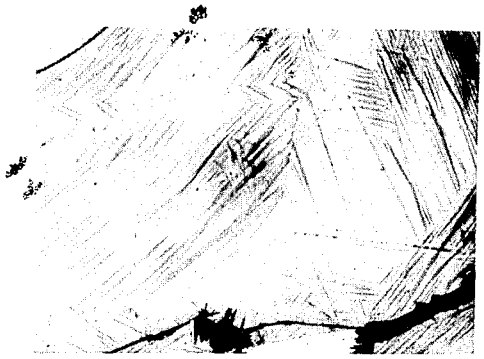
Figure 3B:
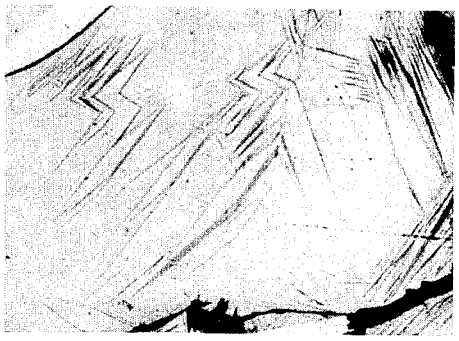
Figure 3E:
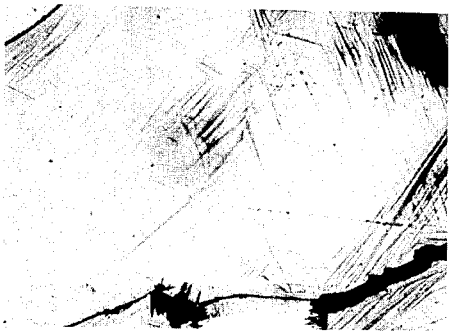
Figure 3C:
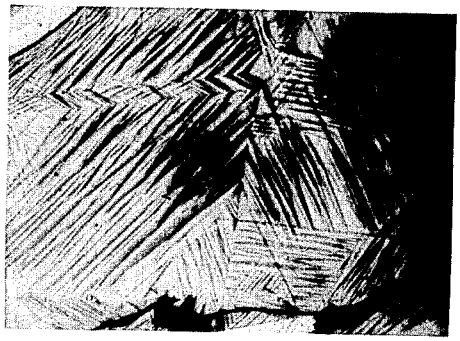

FIGS. 2*a* to 2*i* are examples showing investigated results of the shape memory effect and the pseudo-elasticity with respect to the three specimens mentioned above. The non-aged solution treated specimen does not show any changes in its bent shape (FIG. 2*c*) even if it is heated to the room temperature after the deformation at the liquid nitrogen temperature (FIG. 2*b*). This means that the martensitic transformation does not occur during the deformation at said liquid nitrogen temperature, and the deformation is performed only by the slip in the matrix.

Figure 1C:
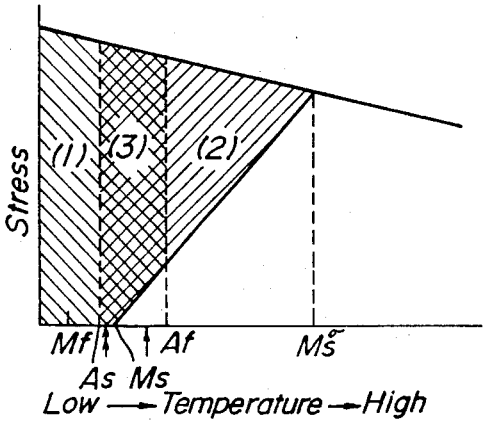
Figure 1F:
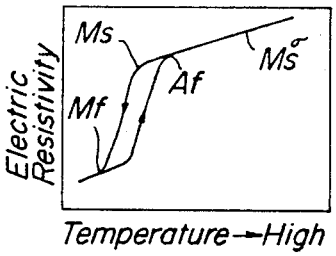

The specimen aged at 700° C. for one hour show a very large spring-back in case of unloading even if the bending deformation is applied thereto at the liquid nitrogen temperature, as shown in FIG. 2*e* (this phenomenon is clearly understood if compared with FIG. 2*b*). In this manner, the pseudo-elasticity such that very large elastic deformation occurs seemingly is recognized. This is because the stress-induced martensite is generated during the deformation and disappears on unloading due to its reverse transformation. In FIG. 1*c*, a position ↑ corresponds to the liquid nitrogen temperature for this aged specimen. Moreover, a littleamount of the permanent deformation remains after a large pseudo-elasticity occurs since a little amount of stress induced martensite is not reversely transformed and remains therein on unloading at the liquid nitrogen temperature.

In the specimen aged at 700° C. for five hours, the bending angle shown in FIG. 2*h* after deformation at the liquid nitrogen temperature is a little smaller than that of the homogeneous solution treated specimen (FIG. 2*b*), and thus a little pseudo-elasticity is recognized. When this specimen is heated to the room temperature, the specimen shows almost complete shape memory effect such that the specimen becomes straight as shown in FIG. 2*i* and the shape before deformation (FIG. 2*g*) is almost all recovered. For this specimen aged at 700° C. for five hours, the liquid nitrogen temperature corresponds to a position ⇑ in FIG. 1*c*, and a little pseudo-elasticity appears since a little part of martensite generated during deformataion is reversely transformed on unloading. In addition, a large shape memory effect also appears since the remained martensite is reversely transformed by the heating above $A_f$ temperature.

Then, the results of the optical microscopic observation with respect to the specimen aged for five hours will be explained. FIGS. 3*a* to 3*e* are optical micrographs showing a surface relief due to the martensitic transformation at various temperatures of −100° C., −140° C., −160° C., −150° C. and −135° C. in the specimen aged for five hours ($M_s$=−127° C., $A_s$=−151° C., $A_f$=−120° C.). As clearly seen from FIGS. 3*a* to 3*e*, the martensite is grown by the cooling and is reversely transformed by the heating. Moreover, a low temperature X-ray diffraction is performed for this specimen, the result of which shows that the martensite has bct structure (c/a=1.14).

The pseudo-elasticity of the alloy according to the invention appears at a low temperature below the room temperature because of its $M_s$ temperature and $A_f$ temperature. Moreover, the shape memory effect appears by the deformation at a temperature below the room temperature and the heating to the room temperature or till about 400° C. after deformation. Further, some specimens show extremely high damping capacity at a temperature below $M_s$ temperature at which the thermoelastic martensite is generated. For example, in the specimen of Fe-33% Ni-4% Ti-10% Co alloy aged at 700° C. for five hours, if the specimen is dropped to the metal plate at the liquid nitrogen temperature, a metallic sound is not heard at all and thus the specimen has good damping and good sound-proof properties. Further, the shape memory alloy according to the invention shows the so-called reversible shape memory effect such that the specimen is naturally bent again if the specimen recovered into the original shape by the heating to a temperature above $A_f$ temperature is cooled again to a low temperature. However, in this case, the shape of the specimen is recovered not completely but partly.

The same examinations are performed for the specimens other than the embodiments mentioned above, each of which has a chemical composition within or without the present invention, and the results thereof show that the specimens having chemical composition of Ni 32–34 wt. %, Ti 3–6 wt. % , Co 10–15 wt. % and the remainder of Fe exhibit the shape memory effect and the pseudo-elasticity due to the formation of the thin-plate martensite, but the other specimens do not show these effects since the thin-plate martensite is not formed. Here, an addition of Ni functions to decrease $M_s$ temperature, and an addition of Ti shows various effects for the strengthening of matrix, the partial ordering of the matrix and the appearance of tetragonality of martensite by uniformly and finely precipitated $\gamma'$-$Ni_3Ti$ particles (ordered fcc: $Cu_3Au$ type) by means of the ausaging operation. Moreover, an addition of Co functions to decrease the shear modulus of the austenite matrix and to increase the Curie point of the matrix so that the volume change during transformation is made small.

As clearly understood from the above, Fe—Ni—Ti—Co alloy according to the invention is a newly developed alloy and has various advantages, as compared with the known shape memory alloy, such as high strength due to the ferrous alloy, good workability and comparatively inexpensive price.

Moreover, as for the application of the alloy according to the invention, it is possible to utilize in various fields as various kinds of fastening parts, connecting parts and devices for controlling a temperature. Further, the alloy according to the invention can be utilized as the damping material (especially at low temperature).

Although the present invention has been explained with reference to specific values and embodiments, it will of course be apparent to those skilled in the art that the present invention is not limited thereto and many variations and modifications are possible without departing from the broad aspect and scope of the present invention as defined in the appended claims.

What is claimed is:

1. An Fe—Ni—Ti—Co alloy with a shape memory effect and a pseudo-elasticity consists of 32–34 wt. % of nickel, 3–6 wt. % of titanium, 10–15 wt. % of cobalt and the remainder of Fe, said alloy having a thin-plate martensitic structure.

2. A method of producing an Fe—Ni—Ti—Co alloy, comprising steps of heating an alloy consisting of 32–34 wt. % of nickel, 3–6 wt. % of titanium, 10–15 wt. % of cobalt and the remainder of Fe to a temperature between 900° C. and 1,200° C. so as to effect a homogeneous solution treatment; and effecting an aging treatment at a temperature between 500° C. and 800° C. for less than 100 hours so as to generate a thin-plate martensite corresponding to a cooling operating or a stress applying operation.

* * * * *